United States Patent [19]

Ellingson

[11] Patent Number: 5,070,327

[45] Date of Patent: Dec. 3, 1991

[54] SIGNALLING MECHANISM

[76] Inventor: Dale Ellingson, 3191 N. Star Rd., Cottage Grove, Wis. 53527

[21] Appl. No.: 405,422

[22] Filed: Sep. 11, 1989

[51] Int. Cl.[5] ..... G08B 5/00

[52] U.S. Cl. ..... 340/815.14; 340/815.12; 340/331; 340/332

[58] Field of Search ..... 340/815.02, 815.13–815.22, 340/331, 332, 825.17, 330, 326

[56] References Cited

U.S. PATENT DOCUMENTS

| | | | |
|---|---|---|---|
| 3,107,348 | 10/1963 | McNeill | 340/517 |
| 3,246,310 | 4/1966 | Keller et al. | 340/523 |
| 3,348,221 | 10/1967 | Duffield | 340/815.14 |
| 3,585,629 | 6/1971 | Baynard, Jr. | 340/331 |
| 3,651,512 | 3/1972 | Summers | 340/286.01 |
| 3,999,176 | 12/1976 | Kellogg et al. | 340/648 |
| 4,276,542 | 6/1981 | Russ | 340/815.22 |
| 4,406,936 | 9/1983 | Ohashi | 340/815.14 |
| 4,556,863 | 12/1985 | Devitt et al. | 340/332 |
| 4,983,960 | 1/1991 | Dunn | 340/332 |

*Primary Examiner*—Jeffery A. Brier

*Attorney, Agent, or Firm*—Jansson & Shupe, Ltd.

[57] ABSTRACT

A signalling mechanism includes a switch having a handle manually movable between first, second and third positions. The switch controls the operation of a light to be attached to it, a porch light or yard light, for example. A circuit interrupting device is activated when the switch is the second position and intermittently illuminates the light. The mechanism also has a position indicating device, a small lamp for example, which is controllably activated for indicating a position of the switch. The signalling mechanism is constructed and arranged to be received in a standard switch outlet box.

7 Claims, 3 Drawing Sheets

SIGNALLING MECHANISM

FIELD OF THE INVENTION

This invention is related generally to signalling mechanisms and, more particularly, to such a mechanism for controlling a light to be attached thereto, an outdoor yard light or porch light, for example.

BACKGROUND OF THE INVENTION

Virtually since the advent of motorized fire and police departments, personnel within those departments have experienced difficulty in identifying the particular site requiring an emergency response. The relatively recent advent of community ambulance services has given rise to the same type of problem with respect to their personnel. If such personnel are unable to quickly locate the site of the emergency, at least valuable time is lost and, very likely, property and persons may be endangered.

The problem of site identification may be compounded by the fact that in smaller communities, fire departments and ambulance services are often staffed by volunteers. Unlike police officers, who are usually full time employees, these volunteers do not have daily opportunity to learn street names and address numbering systems in detail.

Another fact which compounds the problem of proper site identification and more rapid response is that over decades of growth, many communities have adopted unusual or inconsistent address numbering systems. This may be especially true in residential areas at the common boundaries of adjacent communities. Often such communities use street names and/or street numbering systems which differ at such boundaries. As a result, rapid location of an address by emergency personnel may be made much more difficult. Unless one is intimately familiar with the details of such a system is a quick and accurate response possible.

Still another complicating factor which can affect emergency response time arises because communities situated in hilly terrain often have many winding streets. Especially in rural areas, map coordinates rather than sequential address numbers may be used to identify specific residences. Winding streets and often-confusing map coordinate addresses, alone or in combination, can function to frustrate and delay the responsive efforts of emergency personnel.

In any of the foregoing situations, the difficulty of properly and quickly responding to a particular site is further hampered by darkness, especially if accompanied by inclement weather. While these represent some of the situations in which some type of signalling mechanism would be useful to identify a particular building or address, there are several other types of such situations.

For example, elderly and/or handicapped persons may occasionally need to quickly and simply summon aid. A signalling mechanism which is quickly and easily operable and which provides an outdoor signal which is readily-observable to neighbors would be of great benefit to such persons. This would be especially true where a neighborhood understanding existed as to the meaning of such a signal.

Another example of a situation where a signalling mechanism would be highly desirable involves smaller children who return home from school but whose parents are absent from the home. These so-called "latch key" children, especially very small children, could obviously benefit from a signalling mechanism which would permit neighborhood aid to be quickly and easily summoned.

Persons who participate in neighborhood watch programs would also benefit from such a mechanism. For example, if an intruder is detected on the property of a participant, the flashing illumination of an outdoor light conveys a sense of urgency. Additionally, there may be an understanding among the participants that if such a light is observed by them, they will likewise use such a mechanism. The deterrent effect of multiple outdoor flashing lights may well be significant.

To meet a less urgent need, such a mechanism could also be used to identify a house for an arriving guest who may not be familiar with the area.

Examples of signalling and annunciator mechanisms are shown in U.S. Pat. Nos. 3,107,348; 3,246,310; 3,585,629; 3,651,512 and 3,999,176. However, these prior devices have failed to appreciate the need for a signalling mechanism which is especially adapted for residential use and which is configured to illuminate a light, either conventionally or intermittently in a signalling mode.

A signalling mechanism which includes a switch position for intermittently illuminating a light, a porch lamp, for example, and which incorporates a device for indicating when the switch is in the signalling position would be a distinct advance in the art.

OBJECTS OF THE INVENTION

It is an object of this invention to overcome some of the problems and shortcomings of the prior art.

Another object of this invention is to provide a signalling mechanism having a switch manually movable between first, second and third positions.

Another object of this invention is to provide a switch mechanism having a circuit interrupting device for intermittently illuminating a light.

Yet another object of this invention is to provide a signalling mechanism having a position indicating device which is controllably activated for indicating that the switch is in the signalling position.

Another object of this invention is to provide a signalling mechanism which may be readily retrofitted into a standard switch outlet box.

These and other important objects will be apparent from the descriptions of this invention which follow.

SUMMARY OF THE INVENTION

A signalling mechanism includes a switch having a handle manually movable between first, second and third positions. The switch controls the operation of a light to be attached to it, a porch light or yard light, for example. A circuit interrupting device is activated when the switch is the second position and intermittently illuminates the light. The mechanism also has a position indicating device, a small lamp for example, which is controllably activated for indicating a position of the switch. The signalling mechanism is constructed and arranged to be received in a standard switch outlet box.

In a preferred embodiment, the light will be off when the switch is in the first position, will be intermittently illuminated in the signalling mode when the switch is in the second position and will be continuously illuminated when the switch is in the third position. When the switch is in the second position, a circuit interrupting device is activated for intermittently illuminating the light. At the same time, an indicating device shows that the switch is in that position.

In a highly preferred mechanism, the position indicating device is embodied as a lamp, a small neon lamp for example, which is received within the hollow handle. This lamp flashes intermittently when the handle is in the second position. When flashing, this lamp immediately informs the user that the attached outdoor light is flashing to better attract the attention of emergency or other personnel who are responding to a situation at the site.

DETAILED DESCRIPTION OF PREFERRED EMBODIMENTS

The figures depict a signalling mechanism 10 in accordance with the invention.

Figure 1:
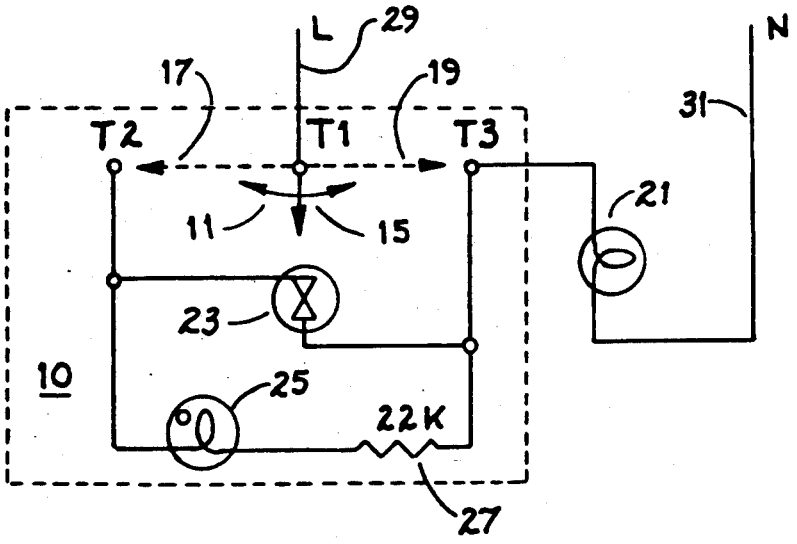
FIG. 1 is an electrical schematic diagram of the signalling mechanism shown in conjunction with a light to be attached thereto.
Figure 2:
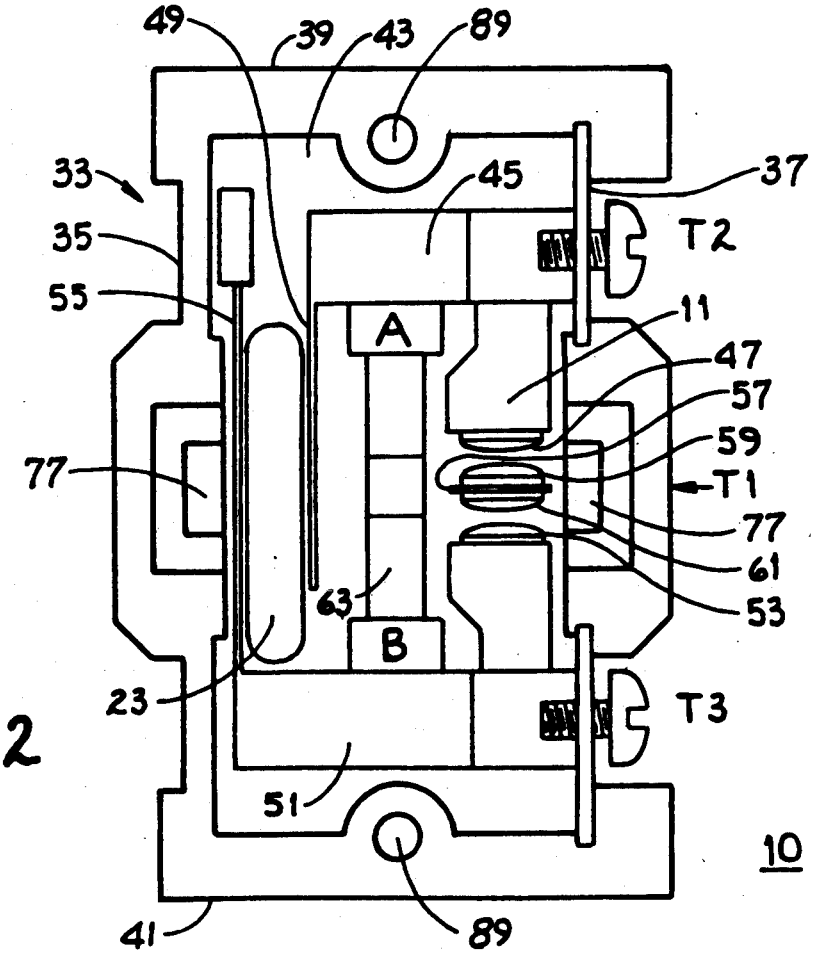
FIG. 2 is a front elevation view of the signalling mechanism with the cover and other parts removed for clarity.
Figure 3:
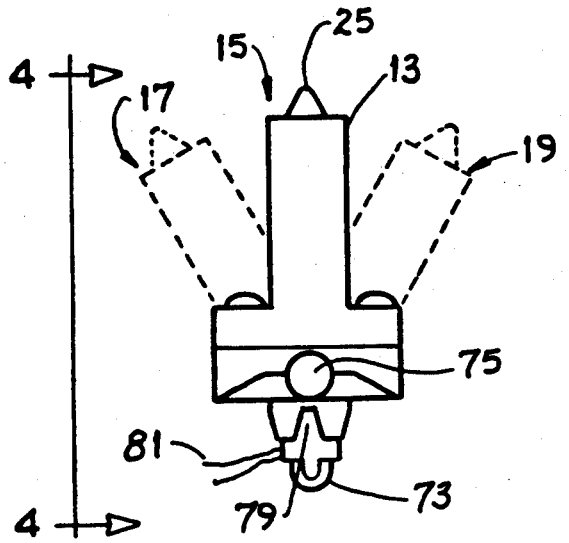
FIG. 3 is a side elevation view of the handle portion of the signalling mechanism.

Referring to FIGS. 1, 2, and 3 the signalling mechanism 10 includes a switch 11 having a handle 13 formed of an insulating material and manually movable between first, second and third positions, 15, 17 and 19 respectively, for controlling a light 21 attached to the mechanism 10. Light 21 could be an outdoor porch or yard light, for example.

In the first position 15, outdoor light 21 is off and in the second position 17, a circuit interrupting device 23 is activated for intermittent illumination of light 21. An indicating device 25, a small neon lamp for example, is in series with a resistor 27, the lamp 25 and the resistor 27 being connected in parallel with circuit interrupting device 23. This indicating lamp 25 emits a flashing signal when switch 11 is in the second position 17. The indicating lamp 25 is not activated when switch 11 is in first position 15 or third position 19. When switch 11 is in the third position 19, outdoor light 21 is illuminated continuously for conventional use.

A terminal T1 is provided for connection to the line side 29 of an AC power source and the terminal T3 is used for connection to one side of light 21. The other side of light 21 is connected to the neutral side 31 of the AC power source.

Referring to FIGS. 2–5, the signalling mechanism 10 includes an insulating housing 33 which contains or supports the various component parts as described following. Housing 33 is a generally rectangular, tub-like structure having a pair of side walls, 35, 37; a top wall 39; a bottom wall 41 and a floor 43. Housing 33 is preferably molded of bakelite or other rigid, insulating material.

Received within housing 33 is an upper conducting strip 45 shaped generally like an inverted L and terminated at one end in a contact 47. Its other end terminates in a finger 49 for making electrical contact with circuit interrupting device 23. The strip 45 is electrically connected to terminal T2 which is brought to exterior of housing 33 at wall 37 by a conventional lug screw T2. The lower conducting strip 51 is generally L-shaped, terminates at one end in a contact 53 and has a leaf 55 at its second end, also for making electrical contact with circuit interrupting device 23.

Circuit interrupting device 23 is disc-shaped (the edge of the disc is shown in FIG. 2) and has two opposed electrical contact surfaces, one of which is generally concentric with each of its circular faces. When circuit interrupting device 23 is inserted edgewise into housing 33 as shown, its contact surfaces engage and establish an electrical circuit with the leaf 55 and the finger 49. In the event of a failure of the device 23, it is readily removable and replaceable so long as the related electrical circuit is de-energized. A preferred device 23 is available from Eagle Company and is constructed so that when an electrical current flows through it for a predetermined, short time, it opens its internal circuit to interrupt the flow of current. Interruption of current will, in a short time, cause the device 23 to re-establish internal circuit continuity and this process is periodically repeated.

A resilient flapper strip 57 is supported within housing 33 at its interior or lower end and extends upward toward the viewer as shown in FIG. 2. At its lower end, this strip 57 is electrically connected to the terminal T1 which is brought to the exterior of the housing by a conventional lug screw (not shown). At its upper end (shown in FIG. 2) and on either side thereof, the strip 57 includes an upper contact pad 59 and a lower contact pad 61, both of which are affixed to the strip 57. From the foregoing description, it will be appreciated that if the strip 57 is moved upward as shown in FIG. 2 to cause pad 59 to touch contact 47, the terminals T1 and T2 will be electrically connected together through circuit interrupting device 23. Similarly, if the strip 57 is moved downward to cause pad 61 to touch contact 53, the terminals T1 and T3 will be directly, electrically connected to one another and device 23 and lamp 25 will be out of the circuit.

Figure 5:
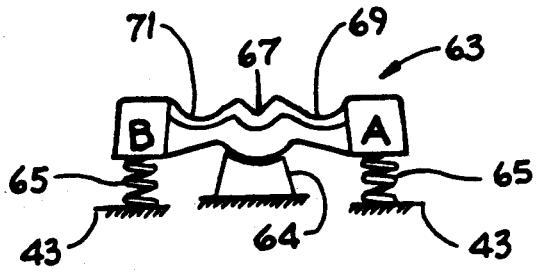
FIG. 5 is a side elevation perspective view of the rocker portion of the signalling mechanism.

As shown in FIG. 2 and 5, a rocker 63 is made of an insulating material, received in housing 33 and supported upon a pedestal 64 for tipping movement. A compression spring 65 is placed between the top ("A") end of rocker 63 and floor 43 and a similar spring 65 is placed between the lower ("B") end and floor 43. These springs 65 tend to urge rocker 63 to a generally horizontal position as shown in FIG. 5. Rocker 63 includes a first detent 67, a second detent 69 and a third detent 71. These detents 67, 69, 71 co-act with nose 73 of handle 13 for retaining handle 13 in the first, second or third position 15, 17, and 19 respectively, following manual movement to a position.

Figure 4:
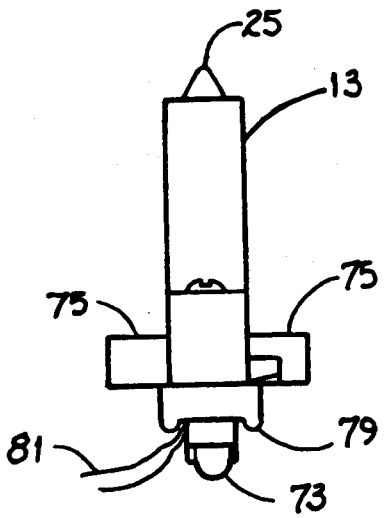
FIG. 4 is a front elevation view of the handle of FIG. 3 taken along the viewing plane 4—4 of FIG. 3.

Referring to FIGS. 2–4, handle 13 includes a pair of generally cylindrical trunnion pins 75, one extending from each side thereof. Pins 75 are sized and located to be pivotably received within corresponding trunnion recesses 77 formed in housing 33. A notch 79 is formed in a lower part of handle 13 and is sized and located to receive the upper end of flapper strip 57 when handle 13 is installed. When handle 13 is in the first, second or third position, 15, 17, and 19 respectively, the nose 73 is in contact with the rocker 63 at the first, second or third detent 67, 69, and 71 respectively.

In a highly preferred embodiment, handle 13 will be hollow to receive and confine a position indicating device such as a small neon lamp 25. The electrical leads 81 for the lamp 25 are brought out through a lower part of handle 13 for connection. One lead 81 is effectively connected to the terminal T2 at any convenient point on upper strip 45. As shown in FIG. 1, the other lead 81 is connected in series to one lead of resistor 27, the other resistor lead being effectively connected to the terminal T3.

Figure 6:
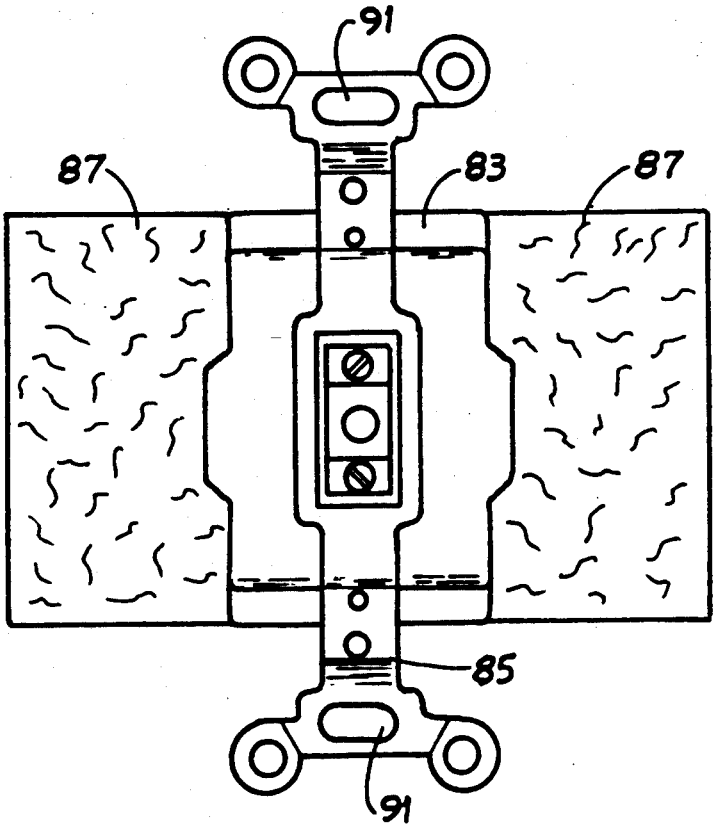
FIG. 6 is a front elevation view of the front cover, mounting bracket and insulating web components of the signalling mechanism.

Referring to FIGS. 2 and 6, the mechanism 10 also includes an insulating cover 83, a mounting bracket 85 and a flexible insulating web 87 interposed between cover 83 and the housing 33. This web 87 may be formed of heavy paper or similar insulating material. When folded inward to cover the terminals T1, T2, and T3, web 87 helps insulate those terminals from the sides of the switch outlet box in which the mechanism 10 may be installed. Cover 83 and mounting bracket 85 are affixed to housing 33 by screws engaging the threaded holes 89 and cover 83 thereby retains rocker 63 and handle 13 in their operative positions described above.

Insulating housing 33, cover 83 and mounting bracket 85 are configured to be received in a conventional switch outlet box. A homeowner who is knowledgeable in local electrical codes, in residential electrical systems and in de-energizing the system will be able to replace a conventional switch with the signalling mechanism 10 when the system is de-energized. When doing so, the mounting bracket for the existing switch (not shown) will typically be retained by machine screws (not shown) inserted through holes such as the holes 91 shown in the illustrated bracket 85. These screws will engage threaded holes in the existing switch box.

Figure 7A:
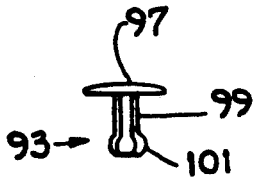
FIGS. 7A and 7B, taken together, are side elevation views of two types of push-type quick connectors for attaching the signalling mechanism to a standard switch box.
Figure 7B:
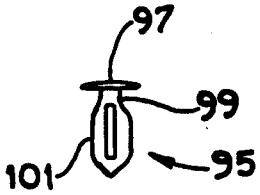

However, the task of retrofit will be made appreciably easier and may be accomplished much more quickly if signalling mechanism 10 is installed in the switch box using push-type quick fasteners. Examples of such fasteners 93, 95 are shown in FIGS. 7A and 7B. Such fasteners 93, 95 include a head 97 and a resilient shaft 99 terminating in a slightly enlarged nose 101. The fasteners 93 or 95 are pushed through holes 91 in bracket 85 and those corresponding holes in the switch box for retention of the mechanism 10. These fasteners 93 or 95 may be supplied in kit form along with the signalling mechanism 10 and will be especially time saving, and therefore cost saving, if retrofit is being performed by a professional electrician. If and to the extent that the use of such fasteners is permitted, such use will be governed by national and local electrical codes.

Referring to the FIGURES and in operation, it is first assumed that the "hot" lead 29 of the AC line has been connected to the terminal T1, one terminal of the light 21 has been connected to the terminal T3 and the second terminal of the light 21 has been connected to the neutral conductor 31 of the AC line. It is also assumed that nose 73 of handle 13 is received in center or first detent 67 of rocker 63. The contacts 59, 61 affixed to flapper strip 57 will therefore be in a spaced relationship to the contacts 47, 53 on the upper conducting strip and the lower conducting strip 45, 51 respectively. With handle 13 in its first position 15 as described above and as shown in solid outline in FIG. 3, the light 21 will be off.

If handle 13 is moved to the left or second position 17 as shown in dotted outline in FIG. 3, flapper strip 57 will be urged upward as shown in FIG. 2 so that electrical contacts 59 on flapper strip 57 and on contacts 47 conducting strip 45 are touching. Current will flow from the terminal T1 to strip 45, through circuit interrupting device 23 and thence to light 21 connected at terminal T3. Light 21 will thereupon be illuminated but since there is relatively little voltage drop across circuit interrupting device 23 at this time, neon lamp 25 will not be illuminated. When the circuit interrupting device 23 automatically opens, the resulting voltage drop across it will cause lamp 25 to be illuminated and light 21 to be extinguished. This action of circuit interrupting device 23 will cause both the outdoor light 21 and neon lamp 25 to flash periodically. Two results are accomplished. Flashing outdoor light 21 serves to unmistakably identify the site for which emergency services have been requested and flashing neon lamp 25 continually signals to the user that light 21 is in the signalling mode.

If the handle 13 is moved to third position 19 as shown in dotted outline in FIG. 3, flapper strip 57 will be urged downward as shown in FIG. 2. This will cause the pad 61 and contact 53 to touch and establish an electrical circuit whereby power may flow from the AC line directly to light 21, bypassing circuit interrupting device 23. Movement of handle 13 between first and third positions 15, 19 respectively, results in conventional "on-off" operation of the light 21.

While the principles of this invention have been described in connection with specific embodiments, it should be understood clearly that these descriptions are made only by way of example and are not intended to limit the scope of the invention.

What is claimed is:

1. A mechanism having an electrical circuit using only AC power and providing an intermittent visual emergency signal and including:
   - a switch handle movable to a first, second or third position;
   - a circuit interrupting device slidably removable from the front of such mechanism and activated when such handle is in the second position;
   - a device for visually indicating when such handle is in the second position;

such mechanism being configurated and arranged such that all portions of such electrical circuit may be received in a standard residential switch outlet box.

2. The mechanism of claim 1 which is devoid of an audible alarm.

3. The mechanism of claim 1 wherein such interrupting device is of the cartridge type readily replaceable from the front of such enclosure.

4. The mechanism of claim 3 wherein such interrupting device is slidably received between an electrical contact with a finger and a leaf.

5. The mechanism of claim 1 further including a switch outlet box, such mechanism being secured in such box by push-type quick fasteners accessible from the front of such box for removal.

6. The mechanism of claim 1 further including a plurality of push-type quick fasteners to form a kit whereby such mechanism may be retrofitted into such switch outlet box.

7. The mechanism of claim 1 wherein such handle includes a nose engaging a symmetrical rocker to maintain such handle in a position.

* * * * *